US008172119B2

(12) United States Patent
Cedar et al.

(10) Patent No.: US 8,172,119 B2
(45) Date of Patent: May 8, 2012

(54) PARALLEL MOTION STAPLER

(75) Inventors: Jonathan Newman Cedar, Scarsdale, NY (US); Przemyslaw Godycki, Brooklyn, NY (US)

(73) Assignee: Staples The Office Superstore, LLC, Framingham, MA (US)

( * ) Notice: Subject to any disclaimer, the term of this patent is extended or adjusted under 35 U.S.C. 154(b) by 630 days.

(21) Appl. No.: 12/264,333

(22) Filed: Nov. 4, 2008

(65) Prior Publication Data

US 2010/0108738 A1 May 6, 2010

(51) Int. Cl.
*B25C 5/11* (2006.01)
*B25C 5/00* (2006.01)

(52) U.S. Cl. ..... 227/120; 227/107

(58) Field of Classification Search ..... None
See application file for complete search history.

(56) References Cited

U.S. PATENT DOCUMENTS

| | | | | |
|---|---|---|---|---|
| 1,446,107 | A * | 2/1923 | Tibbals | 227/95 |
| 2,551,898 | A | 5/1951 | Nyberg | |
| 2,624,046 | A | 1/1953 | Nyberg | |
| 2,651,034 | A | 9/1953 | Vail | |
| 2,738,505 | A | 3/1956 | Vail | |
| 3,022,510 | A * | 2/1962 | O'Malley | 227/78 |
| 3,907,190 | A | 9/1975 | Mitsuhashi | |
| 3,951,325 | A | 4/1976 | Mitsuhashi | |
| D243,148 | S | 1/1977 | Levin | |
| 4,113,164 | A | 9/1978 | Muthenthaller | |
| 4,241,861 | A | 12/1980 | Fleischer | |
| 4,463,890 | A | 8/1984 | Ruskin | |
| 4,496,091 | A | 1/1985 | Yasuda | |
| 4,640,451 | A | 2/1987 | Steiner | |
| 4,727,610 | A | 3/1988 | Lin | |
| D297,300 | S | 8/1988 | McDermott | |

(Continued)

FOREIGN PATENT DOCUMENTS

DE 10051625 A1 5/2002

(Continued)

OTHER PUBLICATIONS

International Search Report and Written Opinion in corresponding International Application No. PCT/US2009/005909 mailed Apr. 29, 2010.

*Primary Examiner* — Lindsay Low
(74) *Attorney, Agent, or Firm* — Wolf, Greenfield & Sacks, P.C.

(57) ABSTRACT

Embodiments described herein relate to a stapler that is constructed in a manner such that the handle of the stapler remains at least substantially parallel to the base as the handle is moved downward by a user to actuate a stapling operation. One illustrative embodiment is directed to a stapler movable between a rest position and a staple ejection position that comprises a base, a stapler body, a handle, and a linkage assembly coupled to each of the base and the handle. The stapler body comprises a strike plate, a magazine, and at least one engagement surface coupled to the strike plate. The handle is operable to actuate the strike plate. The linkage assembly comprises at least one linkage member having at least one actuation surface configured to exert a force on the at least one engagement surface as the at least one actuation surface moves along the at least one engagement surface. The linkage assembly couples the base to the handle in such a manner that the handle remains at least substantially parallel to the base as the handle is moved from the rest position to the staple ejection position.

21 Claims, 6 Drawing Sheets

U.S. PATENT DOCUMENTS

| | | | | | |
|---|---|---|---|---|---|
| 4,878,608 | A | | 11/1989 | Mitsuhashi | |
| D304,902 | S | | 12/1989 | Ebihara | |
| D306,684 | S | | 3/1990 | Chan | |
| 4,981,245 | A | | 1/1991 | Sato | |
| 5,004,142 | A | | 4/1991 | Olesen | |
| D320,539 | S | | 10/1991 | Leff | |
| D331,178 | S | | 11/1992 | Bain | |
| D340,847 | S | | 11/1993 | Bain | |
| 5,356,063 | A | | 10/1994 | Perez | |
| 5,368,214 | A | * | 11/1994 | Schick | 227/147 |
| 5,376,095 | A | * | 12/1994 | Ortiz | 606/143 |
| 5,692,666 | A | | 12/1997 | Dallas | |
| 5,979,736 | A | * | 11/1999 | Edeholt | 227/132 |
| 6,173,949 | B1 | | 1/2001 | Visick | |
| 6,199,852 | B1 | | 3/2001 | Visick | |
| 6,264,087 | B1 | * | 7/2001 | Whitman | 227/180.1 |
| 6,527,157 | B1 | | 3/2003 | Choi | |
| 6,582,451 | B1 | * | 6/2003 | Marucci et al. | 606/207 |
| 6,676,002 | B2 | | 1/2004 | Jairam | |
| 6,763,837 | B2 | * | 7/2004 | von Fuchs | 128/898 |
| D514,904 | S | | 2/2006 | Sauter | |
| 7,021,512 | B1 | | 4/2006 | Nakamura | |
| 7,070,598 | B2 | * | 7/2006 | Lim et al. | 606/99 |
| 7,087,055 | B2 | * | 8/2006 | Lim et al. | 606/99 |
| 7,090,110 | B2 | | 8/2006 | Adams | |
| 7,306,131 | B2 | | 12/2007 | Bargo | |
| 7,494,491 | B2 | * | 2/2009 | Fankhauser et al. | 606/99 |
| 7,625,377 | B2 | * | 12/2009 | Veldhuizen et al. | 606/90 |
| 7,641,671 | B2 | * | 1/2010 | Crainich | 606/205 |
| 7,644,849 | B2 | * | 1/2010 | Tsai et al. | 227/132 |
| 7,763,028 | B2 | * | 7/2010 | Lim et al. | 606/90 |
| 7,850,703 | B2 | * | 12/2010 | Bombard et al. | 606/153 |
| 7,901,409 | B2 | * | 3/2011 | Canaveral et al. | 606/86 R |
| 2006/0016848 | A1 | | 1/2006 | Basti | |
| 2009/0050669 | A1 | | 2/2009 | Zolentroff | |

FOREIGN PATENT DOCUMENTS

| | | | | |
|---|---|---|---|---|
| JP | 04 209620 | | | 7/2004 |
| JP | 2004209620 | A | * | 7/2004 |
| WO | WO 2005 007348 | | | 1/2005 |
| WO | WO 2010/005448 | A1 | | 1/2010 |

* cited by examiner

PARALLEL MOTION STAPLER

BACKGROUND

1. Field

Embodiments of the invention relate to staplers, such as desktop staplers, that may be actuated in a parallel motion.

2. Discussion of Related Art

Staplers are used to join target objects together by driving a staple through the target objects and folding over the ends of the staple to secure the target objects together In the case of desktop staplers, which are widely used in offices and schools, the target objects are generally pieces of paper and the staples are generally comprised of thin metal. It is desirable to improve the ease of use in operating a desktop stapler.

SUMMARY

One illustrative embodiment is directed to a stapler movable between a rest position and a staple ejection position. The stapler comprises a base, a stapler body, a handle, and a linkage assembly that couples the base to the handle. The stapler body comprises a magazine configured to hold staples, a strike plate configured to eject a staple from the magazine when the stapler is in the staple ejection position, a magazine configured to hold staples, and at least one engagement surface coupled to the strike plate. The handle of the stapler is operable to actuate the strike plate. The linkage assembly comprises at least one linkage member having at least one actuation surface configured to exert a force on the at least one engagement surface as the at least one actuation surface moves along the at least one engagement surface. The linkage assembly couples the base to the handle in such a manner that the handle remains at least substantially parallel to the base as the handle is moved from the rest position to the staple ejection position.

Another illustrative embodiment is directed to a method of moving a stapler between a rest position and a staple ejection position in which a strike plate ejects a staple from a staple magazine. The method comprises applying a downward force to a handle of the stapler to cause at least one linkage member, coupled between the handle and a base of the stapler, to move with respect to at least one mount coupled to the handle and exert a force on at least one engagement surface coupled to the strike plate as at least one actuation surface of the at least one linkage member moves along the at least one engagement surface. The handle remains at least substantially parallel to the base as the handle is moved from the rest position to the staple ejection position.

A further illustrative embodiment is directed to a stapler movable between a rest position and a staple ejection position. The stapler comprises a base and a stapler body comprising a strike plate and a magazine configured to hold staples. The strike plate is configured to eject a staple from the magazine when the stapler is in the staple ejection position. The stapler Her comprises a handle operable to actuate the strike plate, and means for coupling the base to the handle in such a manner that the handle remains at least substantially parallel to the base as the handle is moved from the rest position to the staple ejection position.

DETAILED DESCRIPTION

Embodiments described herein relate to staplers that are constructed in a manner such that the handle of the stapler remains at least substantially parallel to the base as the handle is moved downward by a user to actuate a stapling operation. The stapler may operate with improved ease relative to conventional staplers. In particular, the parallel motion of the handle relative to the base during actuation results in a handle having a larger actuation area relative to conventional staplers. To create maximum leverage, conventional staplers are actuated by pressing the end of the handle above the staple ejection region of the magazine. In a parallel motion stapler, a user is not restricted to pressing the handle in a certain area to maximize leverage. The user may actuate the stapler by pressing on any portion of the stapler. This affords more flexibility, and makes the stapler easier to grip and squeeze. Thus, the stapler is well-suited for both hand-held and desktop use. In addition, the unique nature of the actuation mechanism is appealing to users of staplers.

Figure 1:
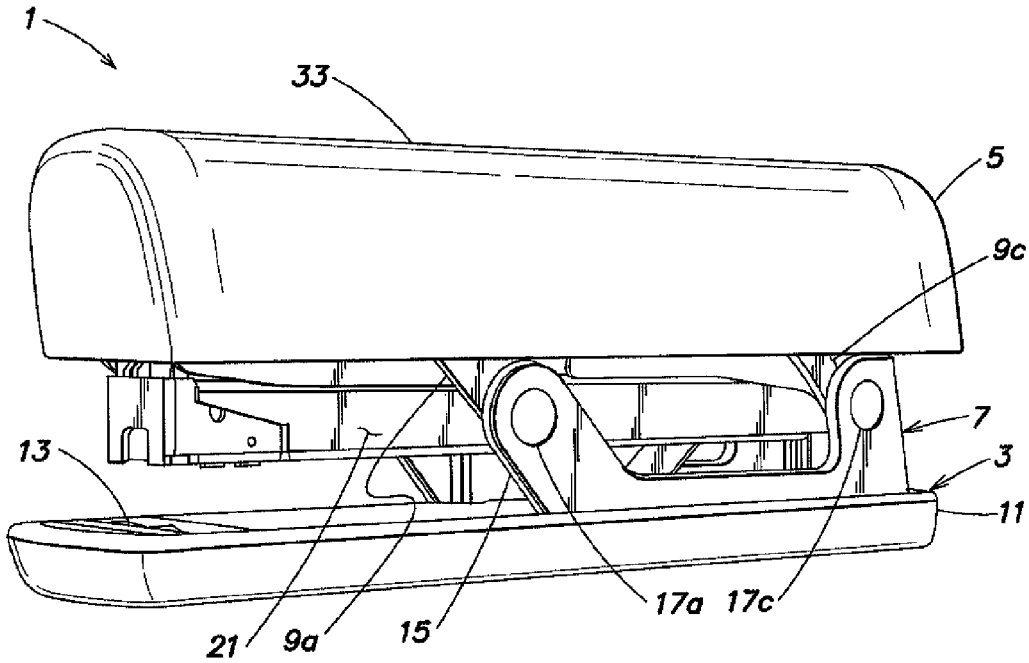
FIGS. 1-3 respectively show a perspective view, cross-sectional side view, and cut away side view of an exemplary embodiment of a parallel motion stapler.
Figure 2:
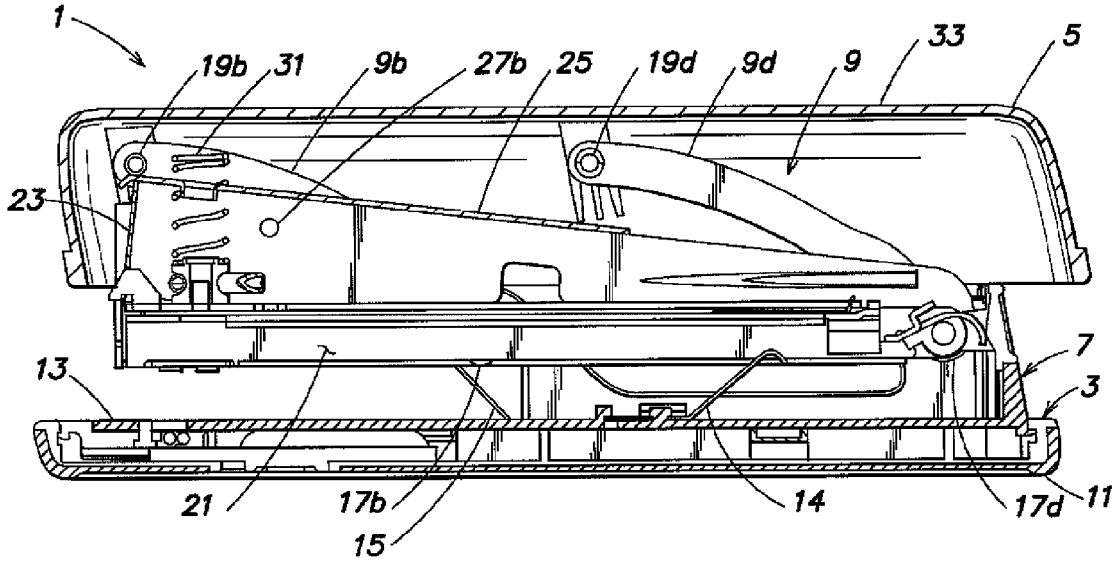
Figure 3:
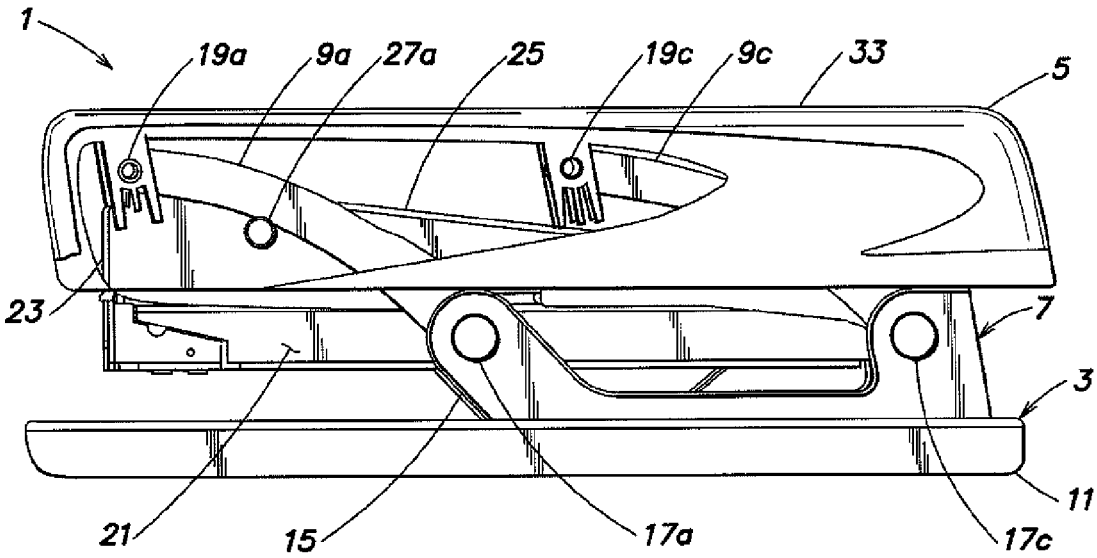

FIGS. 1-3 respectively show a perspective view, cross-sectional view, and cut away view of an exemplary embodiment of a parallel motion stapler. The stapler 1 comprises a base 3, a handle 5, and a main body 7. The base 3 is coupled to the main body 7 via a linkage assembly 9. As described herein, the linkage assembly 9 is constructed such that the handle 5 remains at least substantially parallel to the base 3 as the handle is moved downwardly by a user to actuate a stapling operation. In the embodiment of FIG. 1, the linkage assembly 9 comprises four linkage members, first and second front linkage members 9*a-b* and first and second rear linkage members 9*c-d*.

The base 3 comprises a lower housing 11, an anvil 13, and a support structure 15 for the linkage assembly 9. The linkage assembly support structure 15 comprises first and second front mounts 17*a-b* and first and second rear mounts 17*c-d*, to which the first and second front linkage members 9*a-b* and first and second rear linkage members 9*c-d* are respectively pivotally coupled. Likewise, the handle 5 comprises first and second front mounts 19*a-b* and first and second rear mounts 19*c-d*, to which the first and second front linkage members 9*a-b* and first and second rear linkage members 9*c-d* are respectively pivotally coupled.

The main body 7 comprises a staple magazine 21 configured to hold a strip of staples, a strike plate 23 configured to eject a staple from the staple magazine, and a strike plate support structure 25 that is coupled to and supports the strike plate. In this embodiment, each of the staple magazine 21 and strike plate support structure 25 is pivotally coupled to the base 3 via the first and second rear mounts 17*c-d*, and may be rotated independently about the first and second rear mounts. Alternatively, each of the staple magazine 21 and strike plate support structure 25 may not rotate independently about the first and second rear mounts. In addition, in alternative embodiments, the first and second front mounts 17*a-b* and/or the first and second rear mounts 17*c-d* may be slidably coupled to the first and second front linkage members 9*a-b* and first and second rear linkage members 9*c-d*.

The main body 7 further comprises first and second nodes 27*a-b* coupled to the strike plate support structure 25. Each node may comprise a bushing, rivet, post or some other protuberance, which may be separately formed from or integrally formed with the strike plate support structure 25. Although the nodes of this embodiment are round, the nodes may alternatively be formed in other shapes (e.g., square or oval). In stapler 1, the nodes 27*a-b* are constructed to directly interface the front linkage members 9*a-b*, although an indirect arrangement is alternatively possible.

The location of nodes 27*a-b* may be selected to facilitate the stapling operation. In the embodiment described above, the nodes 27*a-b* are located at a horizontal position that is between a quarter of the distance from the front handle mounts 19*a-b* to the front base mounts 17*a-b* and half the distance from the front handle mounts 19*a-b* to the front base mounts 17*a-b* when the handle 5 is in the rest position. More particularly, the nodes may be located at a horizontal position that is between 30% and 45% of the distance from the front handle mounts 19*a-b* to the front base mounts 17*a-b* when the handle 5 is in the rest position. For example, the nodes may be located at a horizontal position that is approximately 37% of the distance from the front handle mounts 19*a-b* to the front base mounts 17*a-b* when the handle 5 is in the rest position. Of course, the positions described are merely exemplary, and a number of other positions are possible.

Many configurations are possible for loading the staple magazine 21 with staples. For example, the staple magazine 21 may be extendible at the front of the stapler 1 so that staples may be conveniently loaded without displacement of the handle or base. An ejection button may be located at the rear of the main body 7 to cause the staple magazine 21 to extend at the front of the stapler 1.

Figure 4:
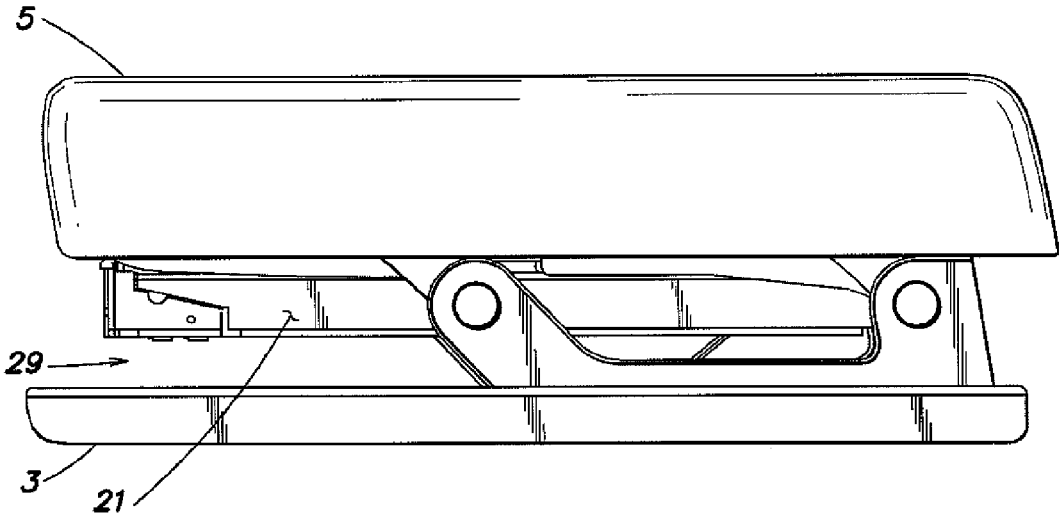
FIG. 4 shows the parallel motion stapler of FIGS. 1-3 wherein the handle in a rest position.
Figure 5:
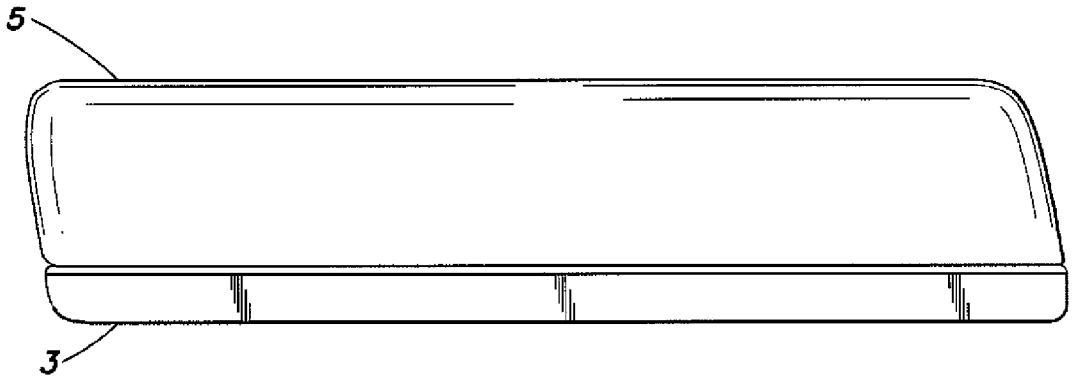
FIG. 5 shows the parallel motion stapler of FIGS. 1-3 wherein the handle in a staple ejection position position.

FIGS. 4 and 5 show two configurations of the stapler 1. FIG. 4 shows the stapler 1 with the handle 5 in a rest position. In the rest position, the base 3 and the handle 5 are maximally vertically displaced with respect to each other, and a paper slot 29 exists between the staple magazine 21 and the base 3. FIG. 5 shows the stapler 1 with the handle 5 in a staple ejection position. In the staple ejection position, the strike plate is in its lowest position and causes a staple contacted by the strike plate to be ejected from the staple magazine. In both the rest post position and the staple ejection position, the handle 5 is at least substantially parallel the base 3. As shown, a top surface of the handle 5 may remain substantially parallel with a bottom surface of the base as the handle 5 is moved closer to the base 3. Further, a longitudinal axis of the handle 5 may remain substantially parallel to a longitudinal axis of the base as the handle 5 is moved closer to the base 3. The handle 5 and base 3 may be constructed such that the lower surface of the handle 5 has substantially the same outer dimensions as the upper surface of the base, as shown in FIGS. 4 and 5. Thus, in the staple ejection position, the handle 5 and base 3 may form a clamshell configuration wherein a cross-sectional area of the handle 5 is at least substantially the same as a cross-sectional area of the base 5.

Figure 6:
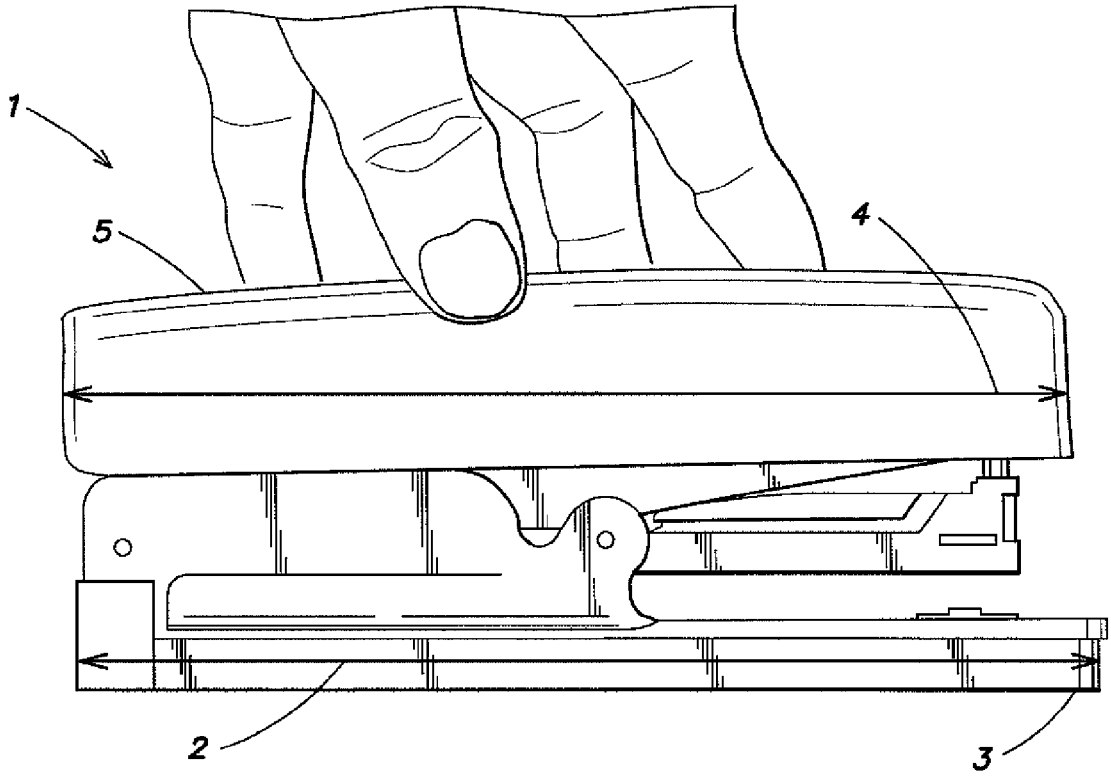
FIGS. 6-8 shows the parallel motion of the handle with respect to the base of the parallel motion stapler of FIGS. 1-3 as the handle moves from the rest position to the staple ejection position.
Figure 7:
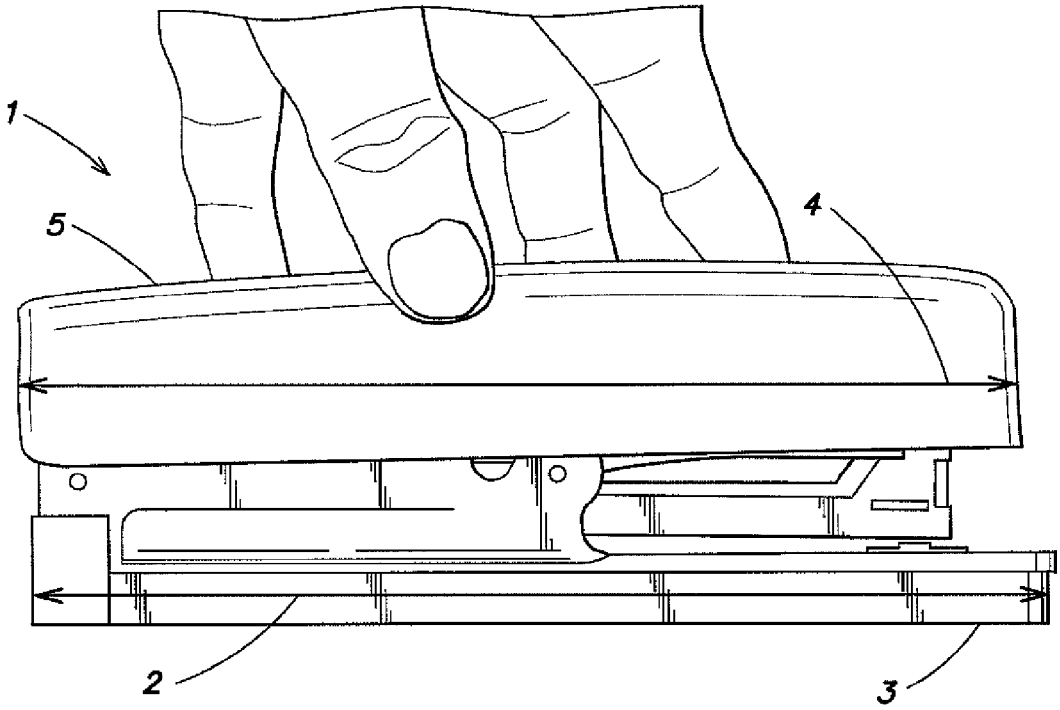
Figure 8:
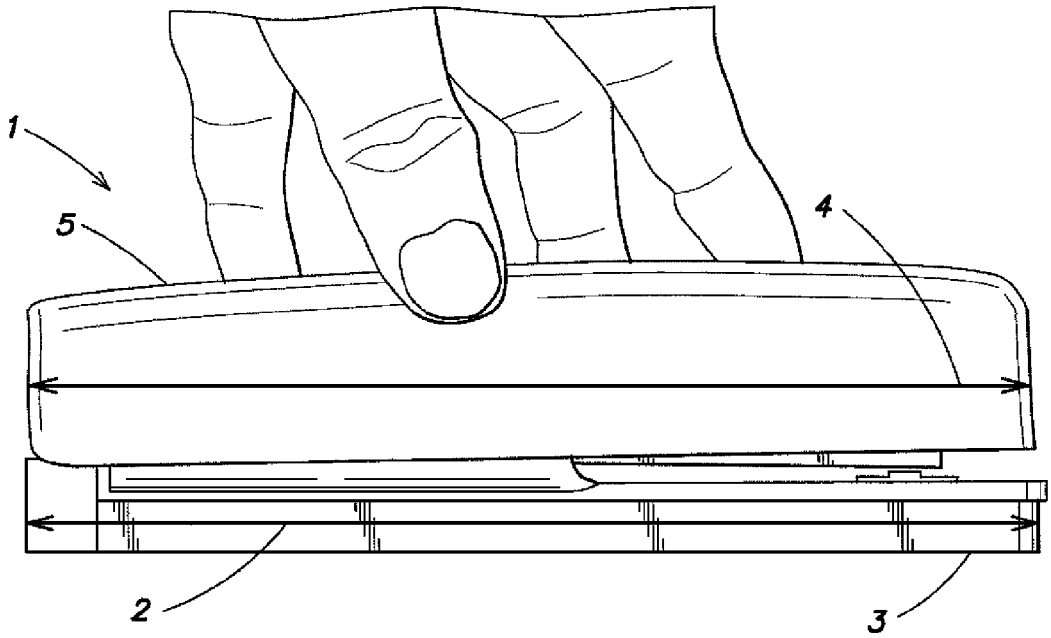

FIGS. 6-8 illustrate the parallel motion of the handle 5 with respect to the base 3 of stapler as the handle moves from the rest position to the staple ejection position. In FIG. 6, the handle 5 of the stapler 1 is in the rest position. As the user presses down on the handle 5, as shown in FIG. 7, the handle 5 moves closer to the base 3, but maintains its parallel position with respect to the base. For example, as shown in FIGS. 6-8, a longitudinal length 4 of the handle 5 maintains its parallel position with respect to a longitudinal length 2 of the base 3 as the handle 5 is moved downwardly. FIG. 8 shows the stapler is a staple ejection position. Likewise, the handle 5 maintains its parallel position with respect to the base 3. As may be appreciated from FIGS. 5 and 8, the base 3 and handle 5 may be in contact with each other or displaced from each other in the staple ejection position.

The base 3 of the stapler 1 may be adapted to stabilize the stapler on a flat surface, such that the base remains in a fixed position on the surface as the handle 5 is pressed downward by a user. For example, the base 3 may comprise a flat surface, stabilizing "legs" or "feet," and/or other attributes conventionally found at the bottom surface of a desktop stapler. However, it should be appreciated that the base 3 need not be situated on a surface and/or along a lower region of the stapler when the stapler is in a resting position or in use. For example, when not in use, the stapler 1 may be oriented vertically by balancing the stapler on its front end or rear end. Further, the stapler 1 may be operated to cause a stapling operation when in a vertical or upside-down orientation such that the base 3 is oriented vertically or in a direction that faces upward.

When the base 3 of the stapler is disposed on a flat surface, the staple magazine 21, strike plate 23, and strike plate support structure 25 move vertically; that is, at least a portion of each of the foregoing components moves downward during the stapling operation. However, these components do not undergo any substantial motion in the directions perpendicular thereto (i.e., forward, backward, and to either side). The handle 5, on the other hand, moves both downward and forward during in the stapling operation. If desired, the stapler 1 could be constructed such that the handle moves only vertically with respect to the base, or so that the handle moves both downward and backward during in the stapling operation. The stapler, of course, may operate in the same manner when not disposed on a flat surface.

With reference again to FIGS. 1-3, the operation of the stapler will now be discussed. A spring 31 is provided between the handle 5 and the staple magazine 21 to bias the handle in a rest position. In addition, a leaf spring 14 is provided between the base 3 of the handle and the staple magazine 21 to cause the magazine to return to its original position. To operate the stapler 1, a user presses an upper surface 33 of the stapler 1, causing the handle 5 to move downward. As the handle 5 moves downward, the slope between the front handle mounts 19*a-b* and the front base mounts 17*a-b* decreases, and the front linkage members 9*a-b* rotate clockwise about the corresponding handle and base mounts. As this occurs, the front linkage members 9*a-b* exert a force on the nodes 27*a-b*, causing the strike plate support structure 25 coupled thereto to move downward. The downward motion of the strike plate support structure 25 causes the strike plate 23 to move downwardly into the staple magazine 21 and exert a force against the lead staple therein. The staple penetrates paper disposed in the paper slot 29 and is ejected from the staple magazine 21. The legs of the staple are clinched on the underside of the paper by the action of the staple magazine forcing the staple against the anvil 13. The anvil 13 may be made from a hard material, such as metal, and may include a pair of wells to receive and bend the staple legs.

The motion of the rear linkage members 9*c-d* during the stapling operation described above substantially mirrors the motion of the front linkage members 9*a-b;* however, in the embodiment described above, the rear linkage members 9*c-d* do not exert a force on nodes or another portion of the stapler main body 7. If desired, one or more nodes to be actuated by the first and/or second rear linkage members 9*a-d* could be provided on the stapler body and could engage the rear linkage members in a manner similar to the engagement of the front linkage members 9*a-b* with nodes 27*a-b*.

Figure 9:
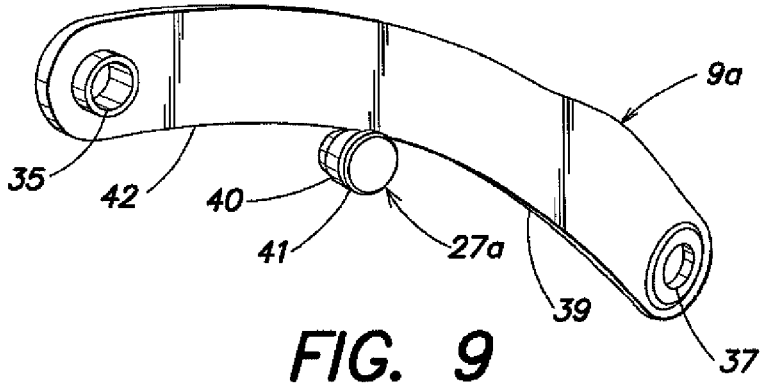
FIG. 9 shows a perspective view of a front linkage member of the parallel motion stapler of FIGS. 1-3 engaging a node of the stapler.

Front linkage members 9*a-b* may be constructed and arranged to optimize the force applied to the nodes 27*a-b*. FIG. 9 shows a perspective view of the front linkage member 9*a* and the node 27*a*, as an example. Front linkage member 9*b* and node 27*b* may be constructed in the same manner, in a mirror image configuration.

The front linkage member 9*a* comprises a front handle mount aperture 35, a front base mount aperture 37, and a curved actuation surface 39. The node 27*a* comprises an engagement surface 40, which engages with the curved actuation surface 39 of the front linkage member 9*a* and receives the force applied by the curved actuation surface 39. In the example of FIG. 9, the engagement surface 40 is the cylindrical surface of a bushing. The node 27*a* further comprises a flange 41 that engages an outer side surface 42 of the front linkage member 9*a*. The flange 41 may guide the front linkage member 9*a* and maintain the orientation between the node 27*a* and the front linkage member 9*a*. Optionally, the bushing and/or flange may be made rotatable about its central axis to ease the motion between the node 27*a* and the front linkage member 9*a*.

The curved actuation surface 39 may have a contour selected based, at least in part, on the desired force to be applied to the nodes during the stapling operation. This force may vary during the stapling operation. According to one example, the curved actuation surface 39 has a substantially constant radius of curvature.

Figure 10:
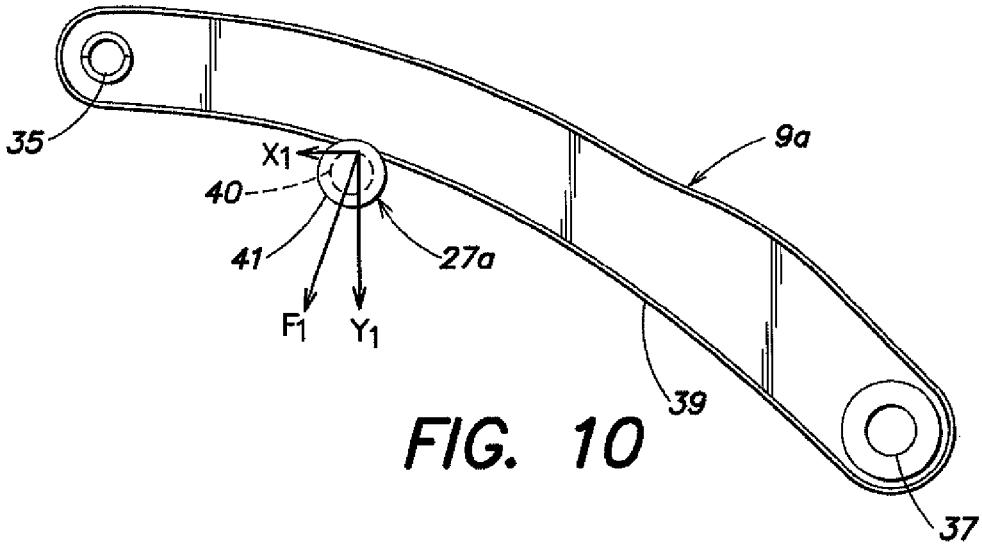
FIG. 10 shows the force applied by the front linkage member on the node when the front linkage member is in a first position during the course of the stapling operation.
Figure 11:
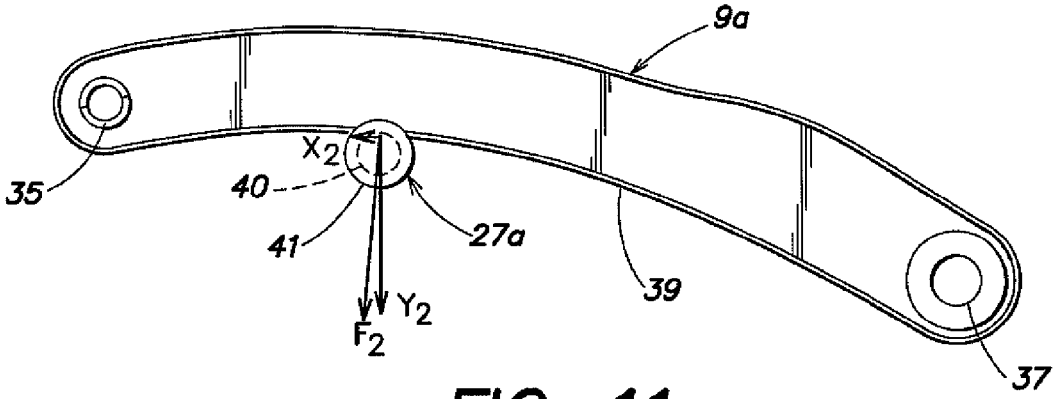
FIG. 11 shows the force applied by the front linkage member on the node when the front linkage member is in a second, later position during the course of the stapling operation.

FIGS. 10 and 11 show the force applied by the front linkage member 9*a* on node 27*a* when the front linkage member is in a first position during the course of the stapling operation (FIG. 10), and when the front linkage member is in a second later position during the course of the stapling operation (FIG. 11). In a first position, shown in FIG. 10, the node 27*a* exerts a force $F_1$, having x-component $X1_1$ and y-component $Y_1$, on the front linkage member 9*a*. As the handle 5 of the stapler 1 shown in FIGS. 1-3 moves downward, the front linkage members 9*a-b* become oriented in a more horizontal position. FIG. 11 shows the front linkage member 9*a* in a second position more horizontal than the first position of FIG. 10. In the second position, the front linkage member 9*a* exerts a force $F_2$, having x-component $X_2$ and y-component $Y_2$, on the node 27*a*. In the second position, the force exerted by the linkage member 9*a* has a smaller x-component and a larger y-component. This lessens the force required to be exerted by the user to effectuate the stapling operation.

In the embodiment described above, front linkage member 9*a* has a curved actuation surface 39, which facilitates stapling operation by the user. However, the invention is not limited to the particular configuration described above. For example, the actuation surface may alternatively be straight, or may have a different degree of curvature than that shown in FIGS. 9-11. The curvature may also be discontinuous, and may vary according to the force desired at various intervals during the stapling operation.

In the embodiments described herein, the rear linkage members 9*c-d* have the same shape and dimensions as the front linkage members 9*a-b*. However, like the front linkage members 9*a-b*, the rear linkage members 9*c-d* may also have different configurations.

Figure 12:
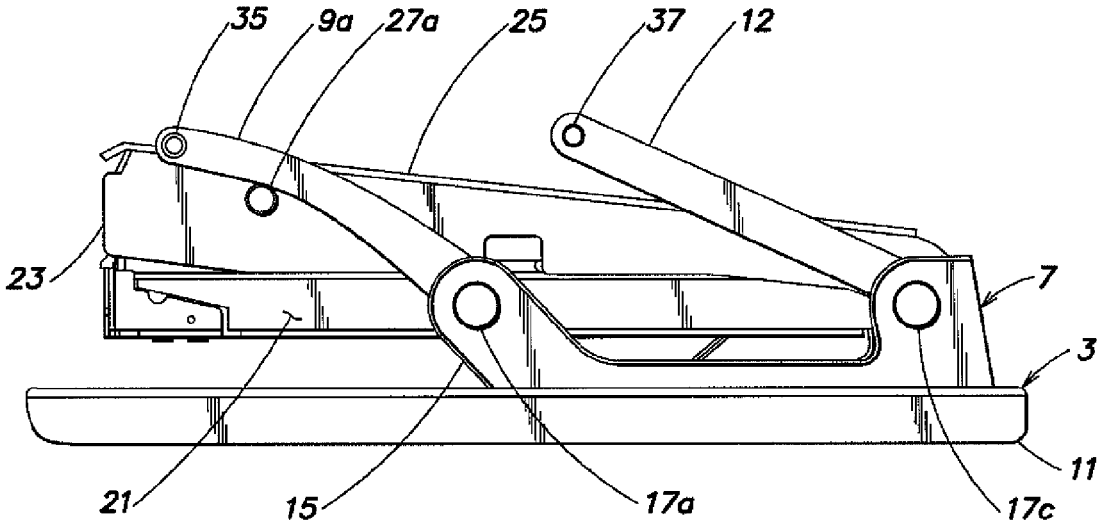
FIG. 12 shows a side view of an exemplary embodiment of a parallel motion stapler having straight rear linkage members, wherein the stapler is shown without the handle to better illustrate the rear linkage members.

FIG. 12 shows a side view of an embodiment of a parallel motion stapler, wherein the handle removed. The embodiment of FIG. 12 is similar to the embodiment of FIGS. 1-3, but replaces first and second rear linkage members 9*c-d* with first and second rear linkage members 12 (only one of which is shown in FIG. 12). The rear linkage members 12 of this embodiment are straight, and operate in a manner akin to rear linkage members 9*c-d*.

Figure 13:
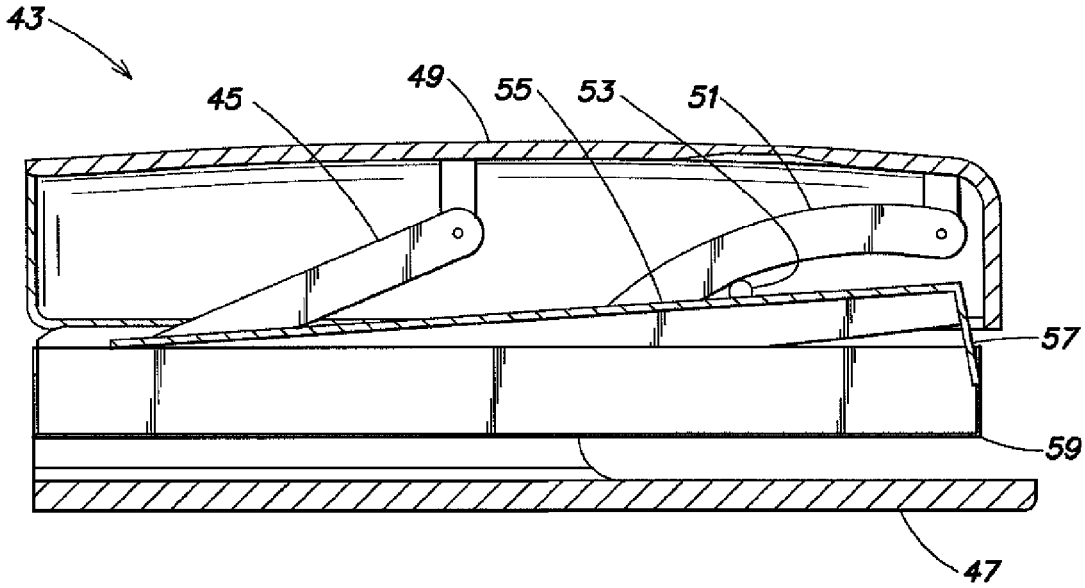
FIG. 13 shows a cross-sectional side view of another exemplary embodiment of a parallel motion stapler.

FIG. 13 shows a cross-sectional view of another embodiment of a stapler 43 wherein a rear linkage member 45 coupled between the base 47 and handle 49 of the stapler is substantially straight. Similar to the embodiment of FIGS. 1-3, front linkage member 51 comprises a curved actuation surface. In FIG. 13, however, the node 53 that engages the front linkage member 51 is located on an upper surface of strike plate support member 55 that supports the strike plate 57. As the front linkage member 51 moves downward during a stapling operation, the linkage member exerts a force on the node 53, causing the strike plate 57 to also move downward and eject a staple from staple magazine 59. In FIG. 13, only one front and rear linkage member are provided. Linkage members 45 and 51 may pass to a side of strike plate support member 55, or may pass though an opening in the support member.

As may be appreciated from the embodiments described above, different numbers and configurations of linkage members are possible. For example, for each of the embodiments described herein, a pair of front linkage members and/or a pair of rear linkage members may be provided, as shown in FIGS. 1-3. Alternatively, for each of the embodiments described herein, a single front and/or rear linkage member may be provided, as shown in FIG. 12. Other configurations are also possible. For example, the rear linkage members may be omitted entirely, the "front" linkage member or members may be located more rearward, or additional linkage members could be included.

For purposes of example, FIGS. 1-12 relate to staplers in the conventional sense. However, the principles described herein may be applied to fastener applicators other than conventional staplers. For example, similar principles may be used in connection with stapleless staplers, which operate by punching out a small flap of paper and weaving it through a notch. The principles may also be applied in connection with spring actuated staplers. Further, the staplers described herein may be used to perform functions other than conventional stapling operations; for example, the staplers may be used to perform tacking or pining operations.

Having thus described several aspects of at least one embodiment of this invention, it is to be appreciated that the present invention is not limited in its application to the details of construction and the arrangement of components set forth in the foregoing description or illustrated in the drawings. Various alterations, modifications, and improvements may readily occur to those skilled in the art. Such alterations, modifications, and improvements are intended to be part of this disclosure, and are intended to be within the spirit and scope of the invention. Accordingly, the foregoing description and drawings are by way of example only.

Further, although certain advantages of the devices and methods described herein have been expressed, these advantages are provided merely to illustrate potential applications, etc., of such devices and methods, and do not define necessary features of the invention. The phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. A desktop stapler movable between a rest position and a staple ejection position, the stapler comprising:

a base;

a stapler body comprising:

a magazine configured to hold staples;

a strike plate, the strike plate configured to eject a staple from the magazine when the stapler is in the staple ejection position; and at least one engagement surface coupled to the strike plate;

a handle operable to actuate the strike plate; and a linkage assembly that couples the base to the handle, wherein the linkage assembly comprises:

first and second front linkage members, each coupled to the base and the handle, the first and second front linkage members having at least one actuation surface configured to exert a force on the at least one engagement surface as the at least one actuation surface moves along the at least one engagement surface; and first and second rear linkage members, each coupled to the base and the handle, the first and second rear linkage members disposed between the first and second linkage members and a rear end of the stapler;

wherein the linkage assembly couples the base to the handle in such a manner that the handle remains at least substantially parallel to the base as the handle is moved from the rest position to the staple ejection position; and wherein the stapler is configured so as to be stabilized in a horizontal position with the handle above the base with respect to a flat surface when the base is resting on the surface.

2. The stapler of claim 1, wherein each of the first and second front linkage members and the first and second rear linkage members is pivotally coupled to each of the base and the handle.

3. The stapler of claim 1, wherein:

the at least one engagement surface comprises first and second engagement surfaces; and wherein the first and second front linkage members comprise first and second respective actuation surfaces configured to exert a force on the first and second engagement surfaces, respectively, as the first and second actuation surfaces move along the first and second engagement surfaces.

4. The stapler of claim 1, wherein the at least one engagement surface is in a fixed position relative to the strike plate.

5. The stapler of claim 1, wherein the at least one actuation surface comprises a concave surface.

6. The stapler of claim 1, wherein the at least one actuation surface comprises a curved contour selected based, at least in part, on the desired force to be applied to the at least one engagement surface during movement of the handle from the rest position to the staple ejection position.

7. The stapler of claim 6, wherein a force applied to the at least one engagement surface during movement of the handle from the rest position to the staple ejection position varies with time.

8. The stapler of claim 7, wherein:

in a first position, the at least one engagement surface exerts a force $F_1$, having x-component $X_1$ and y-component $Y_1$ on the first front linkage member; and in a second, later, position, the at least one engagement surface exerts a force $F_2$, having x-component $X_2$ and y-component $Y_2$ on the first front linkage member, $X_2$ being smaller than $X_1$ and $Y_2$ being larger than $Y_1$.

9. The stapler of claim 1, wherein the at least one engagement surface comprises at least a portion of a cylindrically-shaped surface of a node.

10. The stapler of claim 9, wherein the node comprises a flange that engages with a side surface of the first front linkage member.

11. The stapler of claim 1, wherein the at least one engagement surface is coupled to the strike plate via a strike plate support member.

12. The stapler of claim 1, wherein the linkage assembly couples the base to the handle in such a manner that a longitudinal axis of the handle remains at least substantially parallel to a longitudinal axis of the base as the handle is moved from the rest position to the staple ejection position.

13. The stapler of claim 1, wherein the linkage assembly couples the base to the handle in such a manner that a top surface of the handle remains at least substantially parallel to a bottom surface of the base as the handle is moved from the rest position to the staple ejection position.

14. A method comprising manufacturing the stapler of claim 1.

15. A method of using the stapler of claim 1, the method comprising:

introducing paper into a paper slot between the magazine and the base of the stapler; and applying a downward force to staple the paper.

16. A desktop stapler movable between a rest position and a staple ejection position, the stapler comprising:

a base;

a stapler body comprising:

a magazine configured to hold staples;

a strike plate configured to eject a staple from the magazine when the stapler is in the staple ejection position; and a node having a fixed position relative to the strike plate, the node comprising a curved engagement surface;

a handle operable to actuate the strike plate; and a linkage assembly that couples the base to the handle, wherein the linkage assembly comprises a linkage member comprising an actuation surface configured to exert a force on the curved engagement surface as the actuation surface moves along the curved engagement surface, wherein the linkage member is a first front linkage member and wherein the linkage assembly further comprises a second front linkage member and first and second rear linkage members, each of which is coupled to the base and the handle;

wherein the linkage assembly couples the base to the handle in such a manner that the handle remains at least substantially parallel to the base as the handle is moved from the rest position to the staple ejection position; and wherein the stapler is configured so as to be stabilized in a horizontal position with the handle above the base with respect to a flat surface when the base is resting on the surface.

17. The stapler of claim 16, wherein the linkage assembly is configured such that a force applied to the curved engagement surface during movement of the handle from the rest position to the staple ejection position varies with time.

18. The stapler of claim 16, wherein the actuation surface is concave.

19. The stapler of claim 18, wherein the concave actuation surface is located along a bottom edge of the linkage member.

20. The stapler of claim 16, wherein the first and second rear linkage members are disposed between the front linkage members and a rear end of the stapler.

21. A method of using the stapler of claim 1, the method comprising:

introducing paper into a paper slot between the magazine and the base of the stapler; and applying a downward force to the handle of the stapler to staple the paper.

* * * * *

UNITED STATES PATENT AND TRADEMARK OFFICE

CERTIFICATE OF CORRECTION

PATENT NO. : 8,172,119 B2
APPLICATION NO. : 12/264333
DATED : May 8, 2012
INVENTOR(S) : Jonathan Newman Cedar et al.

It is certified that error appears in the above-identified patent and that said Letters Patent is hereby corrected as shown below:

At column 10, claim 21, line 1, “claim 1” should be replaced by --claim 16--.

Signed and Sealed this
Nineteenth Day of June, 2012

David J. Kappos

David J. Kappos
*Director of the United States Patent and Trademark Office*